United States Patent [19]

Forsythe

[11] Patent Number: 4,907,417

[45] Date of Patent: Mar. 13, 1990

[54] REFRIGERATION CONTROL SYSTEM FOR COLD DRINK DISPENSER

[75] Inventor: David P. Forsythe, St. Louis, Mo.

[73] Assignee: Emerson Electric Co., St. Louis, Mo.

[21] Appl. No.: 171,455

[22] Filed: Mar. 21, 1988

[51] Int. Cl.[4] ..... F25D 17/02

[52] U.S. Cl. ..... 62/199; 62/59; 62/201

[58] Field of Search ..... 62/201, 199, 158, 204, 62/223, 59

[56] References Cited

U.S. PATENT DOCUMENTS

| | | | |
|---|---|---|---|
| 3,557,743 | 5/1971 | Long | 62/212 |
| 3,785,554 | 1/1974 | Proctor | 62/224 X |
| 3,911,354 | 10/1975 | Stanton | 236/75 X |
| 4,067,203 | 1/1978 | Behr | 62/208 |
| 4,459,819 | 7/1984 | Hargraves | 62/212 |
| 4,467,613 | 8/1984 | Behr | 62/115 |
| 4,651,535 | 3/1987 | Alsenz | 62/225 |
| 4,685,309 | 8/1987 | Behr | 62/212 |
| 4,697,431 | 10/1987 | Alsenz | 62/225 |
| 4,754,609 | 7/1988 | Black | 62/59 |

OTHER PUBLICATIONS

Egelhof brochure, "MPS+RTC the New Dimension" undated–Applicant does not admit this is Prior Art.

Egelhof brochure "MPS+RTC the Successful Electronic Controlled Expansion Valve"–Applicant does not admit that this is Prior Art.

*Primary Examiner*—William E. Wayner

*Attorney, Agent, or Firm*—Polster, Polster and Lucchesi

[57] ABSTRACT

A cold drink dispenser and, more particularly a refrigeration system for such a dispenser, is disclosed. The dispenser has a beverage flow path, a first coil or evaporator for prechilling a beverage flowing through the beverage flowpath, and a second or ice bank coil immersed in a liquid bath with the flowpath also immersed in the ice bath. A first modulatable expansion valve (e.g., a pulse modulated solenoid valve) is used to regulate the flow of refrigerant through the first coil and a second modulatable valve is used to regulate the flow of refrigerant through the ice bank coil. A control system (e.g., a microprocessor-based control) monitors certain temperatures and initiates or blocks the flow of refrigerant through one or both of the coils in response to certain pre-established system paramaters so as to insure that the beverage dispensed is below a desired temperature, even under high load operating conditions.

19 Claims, 5 Drawing Sheets

(CONTINUATION)

REFRIGERATION CONTROL SYSTEM FOR COLD DRINK DISPENSER

BACKGROUND OF THE INVENTION

This invention relates to a refrigeration control system, and more particularly to such a refrigeration control system particularly well suited for a cold drink or beverage (or other fluid) dispenser.

Cold drinks or beverages are oftentimes dispensed from a bulk source of the beverage via a dispensing valve and the beverage is refrigerated or otherwise chilled prior to the dispensing of such a cold drink into a cup. The beverage may either be a pre-mixed beverage (i.e., ready to drink from the bulk beverage source) or a post-mixed beverage (i.e., a concentrated syrup mixed with water, or, more usually, carbonated water).

In the dispensing of post-mixed carbonated soft drinks, particularly by high volume users, a severe refrigeration or chilling demand may, from time to time, be placed on the beverage dispensing system. Typically, in a post-mixed system, uncarbonated water from a city water line or the like is chilled by a refrigeration system and is carbonated prior to the chilled, carbonated water being mixed with the syrup to form the finished soft drink beverage. During periods of prolonged dispensing of beverages, particularly when the temperature of the water supply is relatively warm (such as in the summer time), the refrigeration system may not have sufficient refrigeration capability to chill the water down to a predetermined or desired temperature level. This insufficiently chilled water not only affects the temperature of the drink dispenser such that more ice is required to result in a cold beverage for the user, but the amount of carbonation in the drink may not be sufficient to yield a properly carbonated beverage. It will be appreciated that the solubility of carbon dioxide in water is highly influenced by the temperature of the water—the colder the water the more carbon dioxide may be dissolved therein.

Heretofore, beverage dispensers typically utilized an ice bank type water tank acting as a chilling reservoir for chilling the incoming water. In such ice bank reservoirs, a refrigeration coil was immersed in a water bath and the refrigeration coil was operated so as to freeze a quantity of ice around the coil with liquid water also remaining in contact with the ice. The beverage line was immersed in (i.e., in heat transfer relation with) the water in the ice bank water tank. As relatively warm water was circulated through the beverage line in the ice bath, it would be efficiently chilled by the ice bath water. As the water in the beverage line gave off heat to the water bath, a slight rise in temperature of the water bath would cause some ice to melt from the ice bank thus maintaining the water in the water tank at a desired low temperature (i.e., slightly above 32° F.). Thus, as long as the mass of the ice bank would not be melted due to heat transfer to the water to be chilled running through the ice bank water tank, such ice bank systems were effective in chilling the beverage, even when the beverage was dispensed at a relatively high flow rate.

However, in many applications, such as fast food restaurants, movie theatres, and the like which have peak usage periods, the amount of beverage dispensed could overcome the capacity of such ice bank systems resulting in beverages being dispensed at higher than desirable temperatures.

In an effort to overcome this problem, the Cornelius Company of Anoka, Minn. developed a cold drink dispensing system as shown in U.S. Pat. No. 4,754,609, which, in addition to the ice bank water tank heretofore described, utilized a pre-cooling coil in heat transfer relation with the beverage (water) inlet line upstream from the ice bank so as to pre-chill the incoming beverage to lower the temperature of the beverage entering the ice bath to a predetermined maximum value. This pre-cooler coil did not utilize an ice bank and was intended to be in direct (i.e., conduction) heat transfer relationship with the incoming beverage and would be utilized only when the temperature of the incoming beverage exceeded a predetermined temperature level. Both the pre-cooler coil and the ice bank coil were supplied refrigerant from a common refrigeration system compressor and utilized conventional (i.e., mechanical) thermostatic expansion valves to regulate the flow of refrigerant through the pre-cooler coils and the ice bank coils and further utilized on/off solenoid valves to selectively open or block the flow of refrigerant through the pre-cooler coil.

However, it was found that operation of the above described two coil beverage dispensing system utilizing conventional mechanical thermostatic expansion valves was not entirely satisfactory add many desirable functions could not readily be accomplished without the addition of complicated controls and other solenoid valves which would increase the complexity and cost of the two coil beverage dispensing system.

Specifically, it was found that such two coil beverage dispensers controlled by mechanical thermostatic expansion valves experienced problems with the first or precooler coil freezing the water or beverage in heat transfer relation therewith when the flow of refrigerant through the first coil is blocked. Also, upon startup of the compressor, it was difficult to equalize the pressure in the two coils.

In addition to the above described two coil beverage dispensing system, reference should be made to the following U.S. Pat. Nos. which may be material to the examination of this invention: 3,557,743, 4,067,203, 4,459,819, 4,651,535, 4,467,613 and 4,685,309. These above-noted patents disclose various pulse modulated (i.e., open-closed) solenoid valves utilized as expansion valves where the ratio of open to closed time for the valve (duty cycle) was controlled by a suitable proportional or proportional-integration (also known as a sample and hold) control system which compared a system parameter (e.g., superheat) to a setpoint parameter and varied the duty cycle of the solenoid accordingly. However, within in the broader aspects of this invention, other types of modulated expansion valves, such as stepper motor actuated proportional valves or proportional (as opposed to open-closed) direct acting solenoid valves may be used.

SUMMARY OF THE INVENTION

Among the several objects and features of the present invention may be noted the provision of a control system for a cold drink (or other fluid) dispenser refrigeration system enabling more efficient use of the compressor in the refrigeration system for growing ice on the ice bank in a shorter period of time than conventional refrigeration control;

The provision of such a control system which permits efficient use of a pre-cooler coil upstream from the ice bank thereby to maintain the beverage of water inlet temperature to the ice bank at or below a predetermined temperature level even during periods of high usage;

The provision of such a control system which, upon initiation of operation of one of the coils, permits a burst of refrigerant (i.e., a period of non-modulated refrigerant flow) to flow through that coil for effecting thermal stabilization and then to effect pulse modulation control over operation of coil;

The provision of such a system which enables ice bank control, pre-cooler coil control, compressor control, and refrigeration system overload alarms or shutoff in a single package;

The provision of such a control system which enables easy trouble shooting;

The provision of such a control system which provides fail-safe operation of the control system and of the refrigeration system in the event of a component failure in the refrigeration system; and The provision of such a control system which is of rugged construction, which is reliable in operation, and which is accurate in its control function and which is cost efficient.

Other objects and features of this invention will be in part apparent and in part pointed out.

Briefly stated, a cold drink dispensing system is disclosed having a beverage or other fluid source, a beverage outlet, and a beverage flow path between the source and the beverage outlet. The dispensing system further includes a refrigeration system for chilling the beverage as it flows through the flow path to a predetermined temperature level and to maintain the beverage flowing through the flow path at or below this predetermined temperature level. The refrigeration system comprises a compressor and a condenser for receiving high pressure refrigerant from the compressor. A first or pre-cooler coil is supplied with high pressure refrigerant from the condenser, and a second or ice bank coil is also supplied with high pressure refrigerant from the condenser. A suction line is provided for returning refrigerant from each of the coils to the compressor. The beverage flow path is in heat transfer relation with the first and second coils. A first modulating valve is provided between the condenser and the first or pre-cooler coil for effecting expansion of the refrigerant as it flows through the first expansion valve. A second modulating expansion valve is provided between the second or (ice bank) coil and the condenser for effecting expansion of the refrigerant as it flows through the second expansion valve. Control means associated with each of the valves generates a modulated control signal for effecting modulated control of each of the valves thereby to regulate the flow of the refrigerant through each respective expansion valve. The control system further includes means for generating a modulated control signal responsive to the temperature of the beverage in the flow path between the first and second coils constituting a first beverage outlet temperature. Means is provided for generating a signal responsive to the temperature of the beverage discharged from the first coil. Means responsive to the first beverage outlet temperature operates the first valve so as to block the flow of refrigerant therethrough when the first coil beverage outlet temperature is below a first predetermined first coil beverage outlet temperature and so as to permit modulation of the first valve when the first coil beverage outlet temperature is above the above noted first predetermined first coil beverage outlet temperature.

The method of the present invention utilizes a refrigeration system, generally as described above, wherein the method includes generating a modulated control signal for the first valve. Set point signals for each of the valves are generated which are representative of a desired superheat operating condition for each of the coils. The actual superheat condition for each of the coils is monitored. The temperature of the beverage in the flow path discharged from the first coil is monitored. If the beverage outlet temperature from the first coil is below a predetermined temperature level, then the first solenoid valve is operated in such manner so as to block the flow of refrigerant through the first coil. If the beverage outlet temperature from the first coil is greater than the above noted predetermined temperature, the first valve is operated so as to regulate the flow of refrigerant through the first coil such that the actual superheat of the first approximates or equals the desired superheat of the first coil.

DESCRIPTION OF PREFERRED EMBODIMENTS

Figure 1:
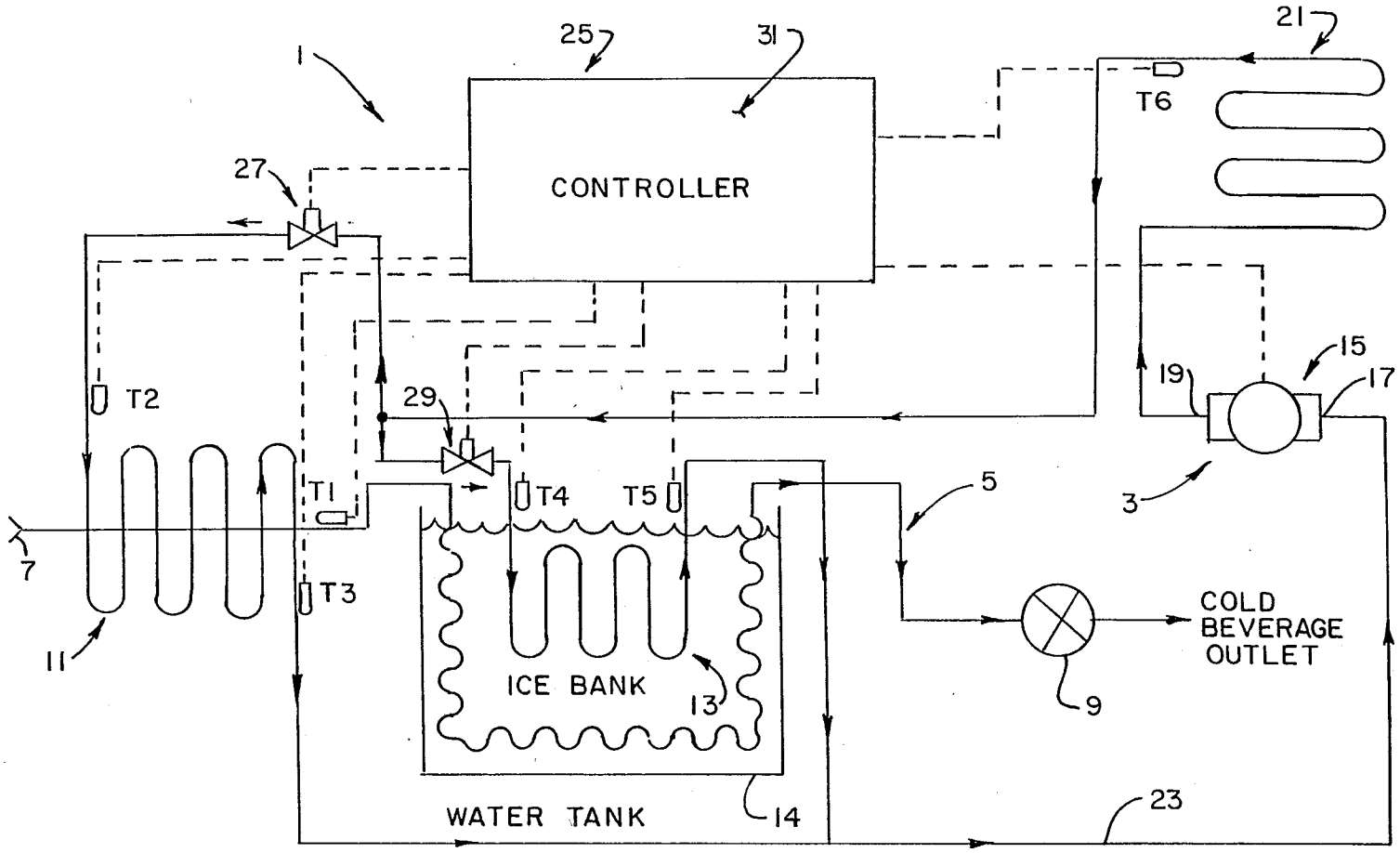
FIG. 1 is a diagrammatic schematic representation of a two coil cold beverage dispenser utilizing a refrigeration control system of the present invention.

Referring now to the drawings, and more particularly to FIG. 1, a cold drink dispenser is indicated in it entirety by reference character 1. The dispenser has a refrigeration system, as generally indicated at 3, with the later having a beverage flowpath 5 extending therethrough from a beverage inlet 7 which draws beverage from the beverage source (not shown) to a beverage dispensing valve 9. Cold drink dispenser 1 may be utilized to dispense either premix or post-mix beverages, as heretofore discussed. Beverage flowpath 5 may, for example, be the flowpath of water through the cold drink dispenser after, or, more preferably, before it is carbonated by a suitable carbonator (not shown) in a manner well known to those skilled in the art. It will be understood that in the cold drink dispenser, chilled carbonated water is preferably delivered to beverage dispensing valve 9 at which point it is mixed in a predetermined ratio with the soft drink syrup to form a finished beverage product as the mixed carbonated water and syrup are dispensed into a cup or other container. However, within the broader aspects of this invention, any type of beverage, including the syrup itself or a premixed beverage may be drawn through beverage flowpath 5 and chilled by refrigeration system 3. It will also be appreciated that fluids other than beverages may be refrigerated or chilled by apparatus similar to dispenser 1.

More specifically, cold drink dispenser 1 includes a first or prechiller coil, as generally indicated at 11, and a second or an ice bank coil 13 disposed within an ice bank water bath 14. Water bath 14 has a quantity of water therein and coil 13 is at least in part immersed in the water such that water will freeze on the coil when refrigeration system 3 is operated. It will be noted that beverage flowpath 5 is in heat transfer relation with the first or prechiller coil 11. The second or ice bank coil 13 is located downstream (referring to beverage flowpath 5) relative to the prechiller coil an the ice bank coil is also in heat transfer relation with the beverage flowpath in that the beverage flow path is, in part, immersed in the water bath. Refrigeration system 3 further comprises a suitable refrigerant compressor 15 having a refrigerant or suction inlet 17 and a refrigerant outlet 19. Refrigerant at relatively high pressure and high temperature discharged from the compressor via outlet 19 is circulated through a condenser coil 21 so as to give off heat to the surroundings. The outlet sides of the first and second coils 11 and 13, respectively, are connected by a suction line 23 to the inlet or suction side 17 of compressor 15 such that the refrigerant, after it has passed through the coils, may be returned to the compressor.

As generally indicated at 25, a refrigeration control system of the present invention is incorporated within cold drink dispenser 1. More specifically, refrigeration control system 25 of the present invention comprises a first modulatable valve 27 interposed between condense 21 and the inlet side of the first or prechiller coil 11. Likewise, a second modulatable valve 29 is interposed between condenser 21 and the inlet side of the second or ice bank coil 13. Valve 27 is sometimes referred to as the prechiller coil electronic (PCE) expansion valve, and valve 29 is sometimes referred to as the ice bank electronic (IBE) expansion valve valve.

Preferably, modulatable valves 27 and 29 are solenoid operated valves similar to those disclosed and discussed in detail in the co-assigned U.S. Pat. Nos. 4,459,819 and 4,685,309 which are herein incorporated by reference. The solenoid valves disclosed in the above-noted U.S. Pat. Nos. 4,489,189 and 4,685,309 are known as direct acting solenoid valves in which a solenoid armature is movable in axial direction with respect to a valve seat between its opened and closed position. In refrigeration systems of relative low capacity, such as the refrigeration system 3 for cold drink dispenser 1 as disclosed herein, such direct acting or axial moving solenoid valves work well. However, in other applications a slide action solenoid valve (not shown) ay be preferred. Such slide action solenoid valves differ from direct acting solenoid valves in that the solenoid actuator moves the vale member generally perpendicular to the axis of the valve seat rather than in axial direction with respect to the valve seat. It will be further understood that, within the broader aspects of this invention, the first and second modulatable valves disclosed herein may be heat motor operated valves such as is disclosed in co-assigned U.S. Pat. No. 3,967,781. Still further, these modulatable valves may also be constituted by solenoid valves which are directly modulated by a variable solenoid current so as to open the valve for a desired percentage of full flowrate therethrough, as opposed to the on-off modulated valves disclosed and described in the above-noted U.S. Pat. Nos. 4,489,819 and 4,685,309. Still further, the modulatable valves may also be constituted by a valve which is selectively moved by a stepper motor or other suitable actuator a desired amount between its closed and fully opened positions such that the flowrate of the refrigerant through the valve may be regulated.

As further described herein, control system 23 for beverage dispenser preferably includes a proportional plus integration (or sample and hold) electronic control strategy for each of the modulatable valves 27 and 29 similar to the control systems of the above-noted U.S. Pat. Nos. 4,489,819 and 4,685,309.

As indicated at T1–T6, six temperature sensors, preferably diode temperature sensors having an operating range between −10° F. and 99° F. and having an accuracy of plus or minus 1° F., are used in control system 23. Specifically, temperature sensor T1 monitors the temperature of the beverage in beverage flowpath 5 at the beverage outlet from precooler coil 11. This temperature is referred to as the first or prechiller coil beverage outlet temperature. Temperature sensor T2 is applied to the refrigerant line at the refrigerant inlet to precooler coil 11. Temperature senser T3 monitors the temperature of the refrigerant at the outlet or suction side of precooler coil 11. It will be appreciated that the temperature difference of the refrigerant between sensor T2 and T3 is a good approximation of superheat of the refrigerant flowing through precooler coil 11. Reference my be made to the co-assigned U.S. Pat. No. 067,203, which is also herein incorporated by reference, for a more detailed disclosure of monitoring the flow of refrigerant through an evaporator or refrigerant coil.

Those skilled in the art will understand that the term "superheat" refers to the temperature difference between the actual temperature of the refrigerant as it is discharged from an evaporator and the boiling or vaporization temperature of the refrigerant at the pressure of the refrigerant in the evaporator coil. It is desirable that the superheat of the refrigerant as it exits the coil being somewhat greater than zero (i.e., that the temperature of the refrigerant be somewhat above its vaporization temperature at the pressure level of the refrigerant within the evaporator coil) thereby to insure that only refrigerant vapor, and not liquid refrigerant, is returned to a suction side of compressor 15 thereby minimizing the the possibility of damage to the compressor. By providing a modulatable expansion valves 27 and 29 for coils 11 and 13, respectively, the flowrate of the refrigerant through the respective coils may be regulated or modulated so as to maintain a desired amount of superheat in the refrigerant exiting the coils. In this manner, liquid refrigerant at relatively low pressure is maintained in heat transfer relation with substantially of the entire length of the evaporator coils thereby to facilitate a maximum amount of heat absorption by the coils throughout the entire length of the coils, while insuring that only vaporized refrigerant exists in the last increment of the length of the coil so as to insure that only vaporized refrigerant is returned to the compressor.

Likewise, temperature sensors T4 and T5 are provided at the inlet and outlet ends, respectively, of the ice bank refrigeration coil 13 to determine the superheat of the refrigerant exiting the ice bank coil. A sixth temperature sensor T6 monitors tee temperature of the refrigerant discharged from condenser coil 21. In a manner as will appear, by monitoring the temperature of refrigerant discharge from coil 21 by temperature sensor T6, the controller 31 of the present invention may shut down refrigeration system 3 in the event the temperature of the refrigerant discharged from condenser 21 exceeds a predetermined valve (e.g., 150° F. or more).

Figure 4:
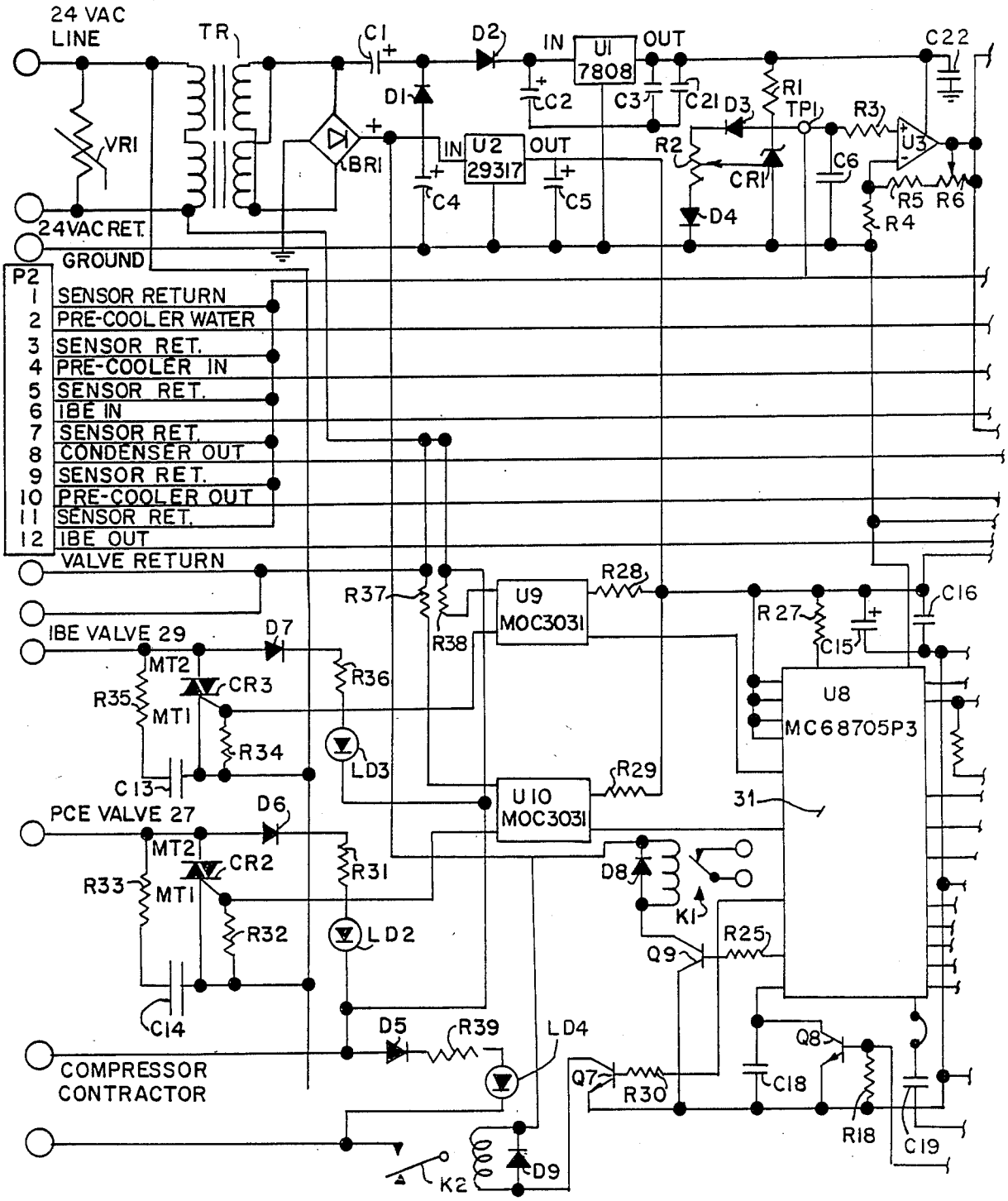
FIGS. 4 and 4A are an electrical schematic of the control system of the present invention used with the beverage dispenser shown in FIG. 1; and Corresponding reference characters indicate corresponding parts throughout the several views of the drawings.
Figure 4A:
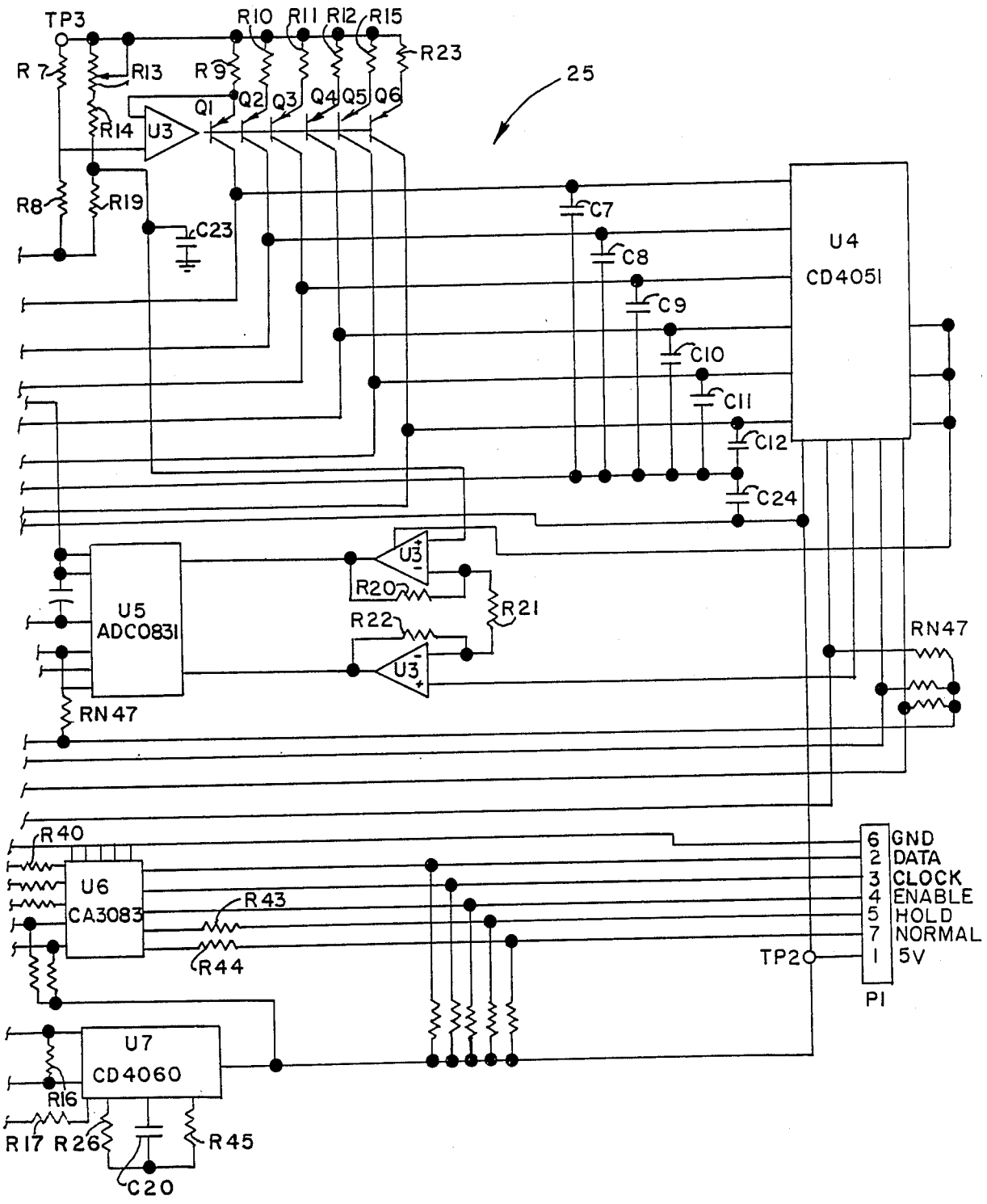

Referring now to FIG. 4, an electrical schematic of control system 25 is shown. In the following table, the values for the various components together with their common-identifications are provided sketches such that one of ordinary skill in the art could readily construct and operate controller 31 of the present invention.

TABLE I

| ITEM | DESCRIPTION |
|---|---|
| D1–D9 | DIODE IN 4001 |
| TP1, TP2, TP3 | TEST PT. |
| RN49 | RESISTOR NETWORK 10-PIN, 4.7K |
| RN47 | RESISTOR NETWORK 8-PIN, 4.7K |
| R13 | TRIMPOT, 200 ohms |
| R6 | TRIMPOT, 500 ohms |
| R2 | TRIMPOT, 10K |

| | |
|---|---|
| R37, R38 | RESISTOR ½W, 5%, 3K |
| R33,R35 | RESISTOR 100 ohms |
| R31, R36, R39 | RESISTOR 2.2K |
| R28, R29 | RESISTOR 220 ohms |
| R9, R10, R11 | RESISTOR ¼W,.5%, 988 ohms |
| R12, R15, R23 | RESISTOR ¼W, .5%, 988 ohms |
| R45 | RESISTOR 1%, 511K |
| R27 | RESISTOR 13.3K |
| R26 | RESISTOR 422K |
| R21 | RESISTOR 1.47K |
| R20, R22 | RESISTOR 13.7K |
| R19 | RESISTOR 1.07K |
| R14 | RESISTOR 2.49K |
| R8 | RESISTOR 3.01K |
| R7 | RESISTOR 2K |
| R3 | RESISTOR 1%, 499 ohms |
| R25, R30 | RESISTOR 5%, 10K |
| R17, R40, R41, R42 | |
| R43, R44 | RESISTOR 47K |
| R16, R18 | RESISTOR 100K |
| R5 | RESISTOR 750 ohms |
| R1 | RESISTOR, ¼W, 5%, 4.7K |
| P2 | CONNECTOR, FRICTION LOCK, 12-PIN |
| P1 | CONNECTOR, SUB-MINIATURE "D", 9-PIN |
| CR2, CR3 | TRIAC, T2322A |
| CR1 | REF. DIODE, LM 336Z |
| Q7, Q8, Q9 | TRANSISTOR, MPSA13 |
| Q1–Q6 | TRANSISTOR, 2N3906 |
| K1, K2 | RELAY, 6 V |
| LD4 | DIODE, LED, GREEN |
| LD3 | DIODE, LED, YELLOW |
| LD2 | DIODE, LED, ORANGE |
| U9, U10 | I.C., MOC3031 |
| U8 | MICRO-PROCESSOR ASS'Y., MC 68705P3 |
| U7 | MICRO-PROCESSOR ASS'Y., CD4080BE |
| U6 | MICRO-PROCESSOR ASS'Y., CA3083 |
| U5 | MICRO-PROCESSOR ASS'Y., ADC0831 |
| U4 | MICRO-PROCESSOR ASS'Y., CD4051BE |
| U3 | MICRO-PROCESSOR ASS'Y., LM324 |
| U2 | MICRO-PROCESSOR ASS'Y., LM2931T-5.0 |
| U1 | I.C., MC7808 |
| C19, C20 | CAPACITOR, FILM, .001MF |
| C18 | CAPACITOR, FILM, 1MF |
| C15, C17 | CAPACITOR, TANT., 10MF/25V |
| C7 THRU C12 C16, C22 THRU C24 | CAPACITOR, FILM, 1MF |
| C6, C21 | CAPACITOR, FILM, 01MF |
| C5 | CAPACITOR, ELEC., 100MF/10V |
| C4 | CAPACITOR, ELEC., 1000MF/16V |
| C3, C13, C14 | CAPACITOR, FILM, .47MF |
| C1, C2 | CAPACITOR, ELEC., 330MF/16V |
| BRI | BRIDGE, VM08 |
| VRI | VARISTOR |
| TR | TRANSFORMER |

Figure 2A:
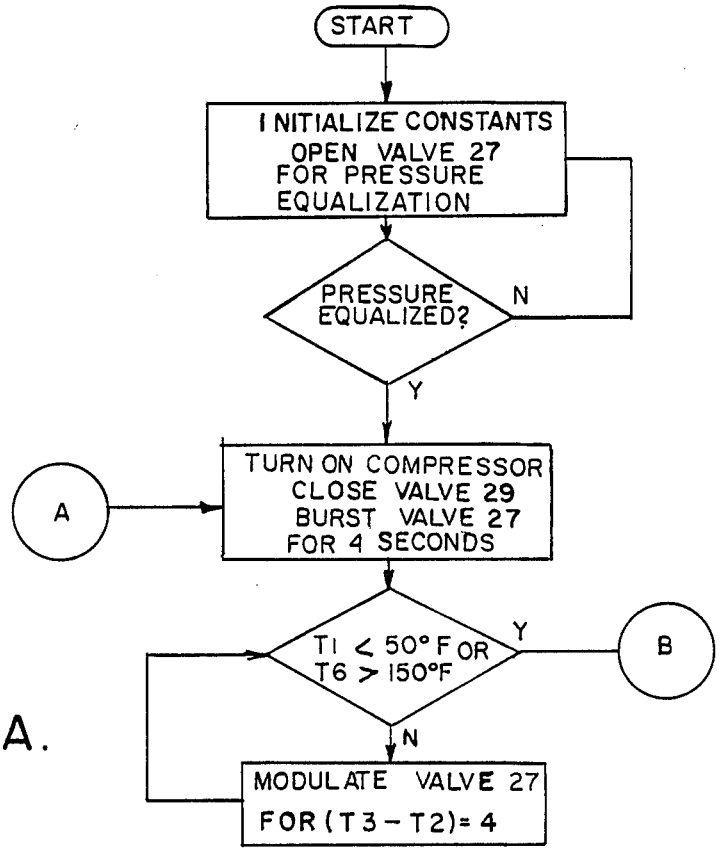
FIGS. 2A–2C depict a flow-chart for the refrigeration control system of the present invention.
Figure 2B:
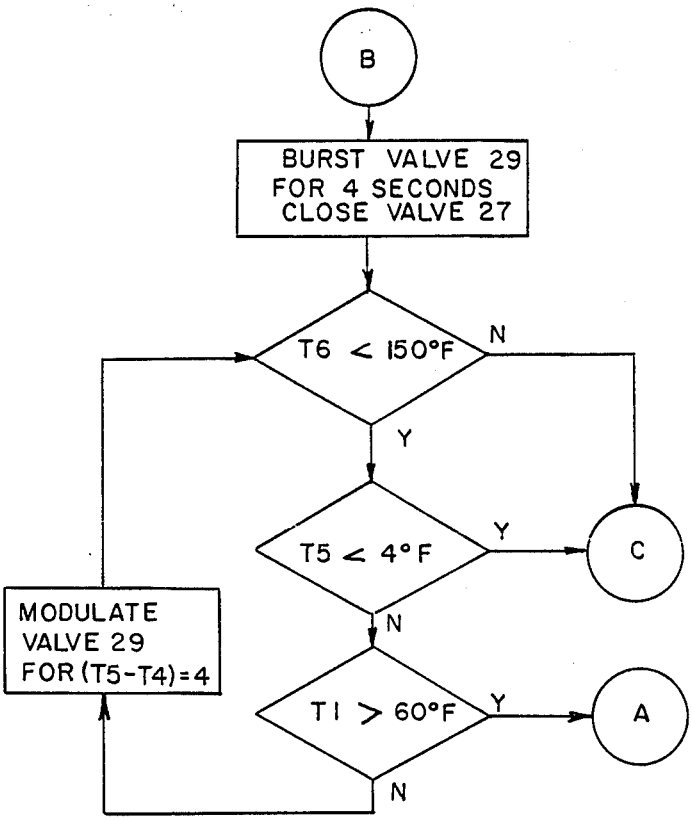
Figure 2C:
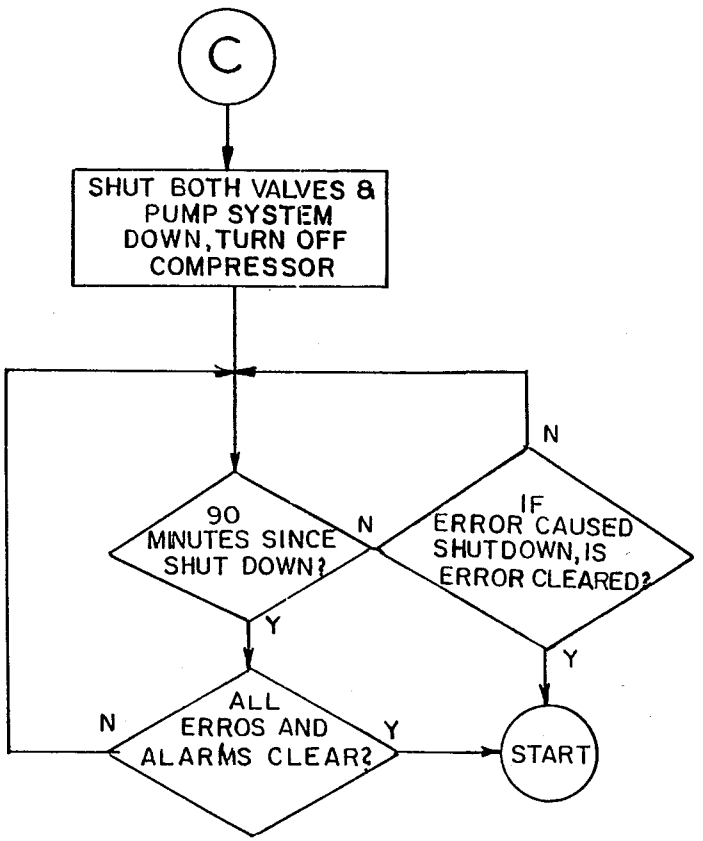

Referring now to FIGS. 2A–2C, a control flow chart for the refrigeration control system 25 of the present invention is disclosed. It will be understood that the various steps and logic decisions shown in FIGS. 2A–2C are carried out by software or programmed steps incorporated in microprocessor U8, or shown in FIG. 4 in a manner well known to those skilled in the art.

Figure 3:
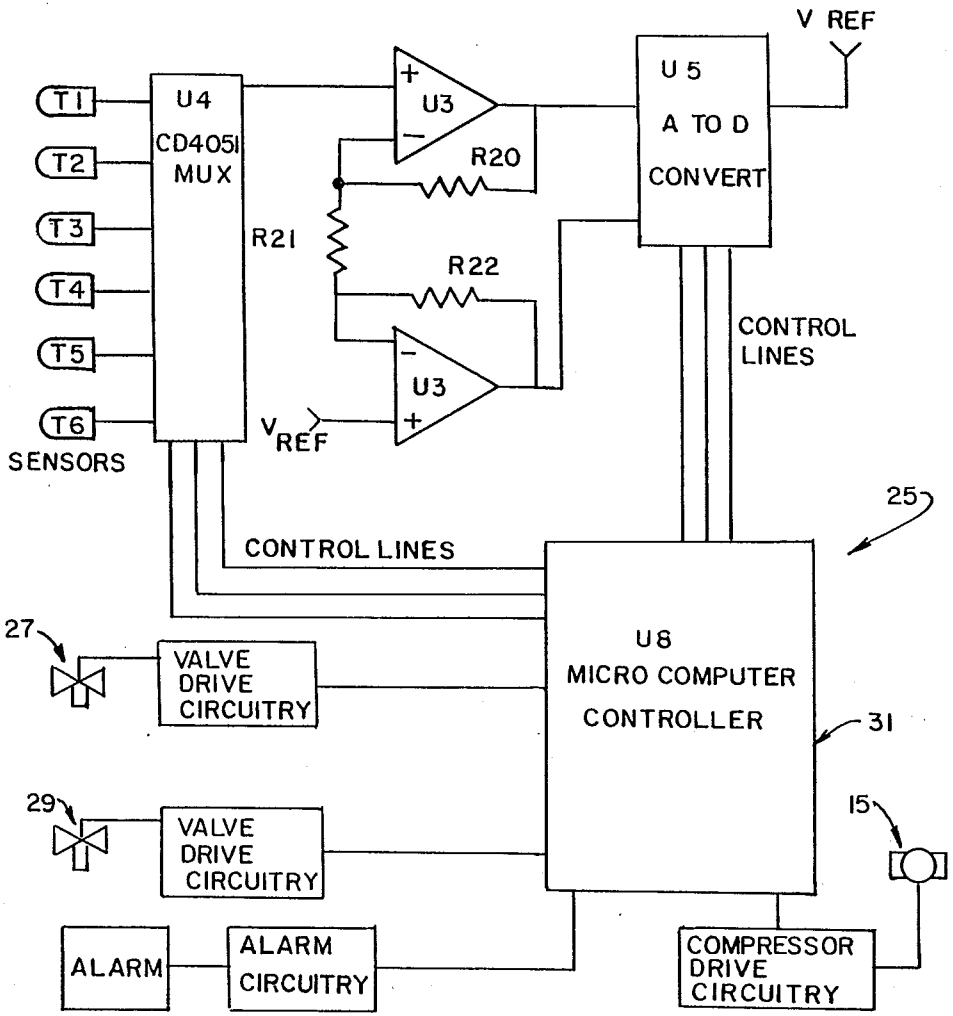
FIG. 3 is a block diagram of a control system of the present invention utilized to control a two coil beverage dispenser, as shown in FIG. 1.

At start up of the cold drink beverage dispenser 1 a number of the constant value parameters within microprocessor controller 31, as shown in FIG. 4, may, optionally be initialized. This initialization start up routine opens valve 27 so as to equalize the pressure of refrigerant in both coils 11 and 13. Once the pressure between the coils has been substantially equalized, the microprocessor controller 31 sends a signal to the compressor drive circuitry or contractors, as shown in FIGS. 3 and 4, thereby to initiate operation of compressor 15 in manner well known to those skilled in the art. Thus, a description of the compressor drive circuitry is omitted for the purposes of brevity.

Upon start up of compressor 15, the control system 25 of the present invention may, optionally, close valve 29 and open valve 27 for a so called burst period of predetermined length (e.g. 4 seconds) so that a quantity of refrigerant, in an unmodulated fashion, is caused to flow through coil 11. The purpose of the burst opening of valve 27 serves two functions. First, it tends equalize the pressure between coil 11 and 13 inasmuch as these coils are in communication with a common source of high pressure refrigerant fe from condenser 21 and further inasmuch as the outlets of both coils are in communication with suction line 23. Also, by affecting the burst opening of valve 27, an initial of flow of refrigerant through coil 11 is established. This initial flow of refrigeration through coil 11 thermally stabilizes the coil and allows temperature sensors T2 and T3 to effect control over the flow of refrigerant through the coil 11. Still further, the flow of refrigerant through the precooler tends to clear the precooler coil of low temperature refrigerant that may have backflowed into coil 11 from coil 13 while the modulated solenoid valve 27 for coil 11 was closed. It will be appreciated that if low temperature refrigerant from coil 13 backflows into coil 11 and remains there for a substantial length of time, this cold refrigerant may cause freezing in beverage flowpath 5 as the beverage flowpath flows through coil 11 and is in heat transfer relation therewith.

It will be understood that in certain applications, the above-noted burst opening of operating valves 27 and/or 29 upon startup may not be necessary. Whether such burst operation of the valves is desirable may depend on system operating conditions and the size of refrigeration system 3. Those skilled in the art may use their judgement whether the benefits of such burst operation of the modulatable valves 27 and 29 (i.e., thermal stabilization and removal of excessively cold refrigerant) is desirable.

If one of two conditions exist, controller 31 will provide an appropriate output signal to modulatable solenoid expansion valve 27 in the manner heretofore disclosed in the above-noted U.S. Pat. Nos. 4,459,819 and 4,685,309. Preferably, controller 31 utilizes a proportional and integration control strategy (also referred to as a sample and hold strategy) similar to that disclosed in these two above-noted U.S. patents which are herein incorporated by reference. In this manner, expansion valve 27 for coil 11 is modulated so as to establish a flow of refrigerant through coil 11 at such a flowrate as to maintain a predetermined superheat (i.e., the refrigerant temperature difference monitored between temperature T2 and T3). For example, such a desired superheat for coil 11 may be about 4° F. This preselected or desired superheat for coil 11 constitutes a desired setpoint value such that control system 25 will control the flow of refrigerant through valve 27 such that the actual operation of the first valve 27 will approximate this setpoint value. The two conditions under which modulation of valve 27 for coil 11 will occur are where temperature sensor T1 monitoring the temperature of a beverage in flowpath 5 downstream from precooler coil 11 is greater than a predetermined beverage outlet temperature (e.g. 50° F.), or if the temperature of the refrigerant discharged from condenser coil 21 is less than a predetermined refrigerant condenser outlet temperature a predetermined refrigerant condense outlet temperature (e.g., 150° F.). By insuring that the beverage outlet temperature from precooler coil 11 is 50° F. or less, it has been found that the chilling capacity of the ice bank, as established by the size (mass) of the ice bank on coil 13, will have sufficient reserve capacity to chill the beverage from 50° F. down to another predetermined temperature (35°–38° F.) and the ice bank will have sufficient reserve capacity to chill the beverage flowing through flow path 5 for extended periods of time, such as during periods of high beverage dispensing. However, when the temperature of the beverage in flowpath 5 discharged from precooler coil 11 exceeds 50° F., then controller 31 of the present invention will initiate modulation of valve 27 thereby to cause the flow of refrigerant through precooler coil 12 which will remove heat directly from the beverage flowing through flowpath 5 as the beverage flows through the precooler coil thereby to lower the temperature of the beverage coming into the ice bank cooler coil 13 to as low as level as possible or to 50° F. or which ever is greater. In this manner, the refrigeration capacity of coil 11 is used only when needed, (i.e., only when the temperature of beverage discharged from precooler coil 11 exceeds a predetermined limit (e.g., 50° F.)).

In the event that the temperature of beverage discharged from coil 11 is less than its predetermined temperature level (e.g., 50° F.), or in the event the temperature of the refrigerant discharge from condenser coil 21 exceeds its predetermined temperature limit (e.g., 150° F.), another phase of the control strategy, as shown in FIG. 2B, of the control system of the present invention is initiated. In that event (i.e., if temperature sensor T1 senses a beverage outlet temperature less than 50° F., or if the temperature sensor T6 senses a refrigerant temperature discharge from the condenser coil in excess of 150° F.), microprocessor control 31 initiates a burst opening (i.e., a non-modulated opening) of valve 29 for a predetermined length of time (e.g., 4 seconds) and closes valve 27 thereby to block the flow of refrigerant through coil 11. Then, if the temperature of the refrigerant discharged from condenser 21 is less than a predetermined value (e.g., 150° F.), if the temperature of refrigerant discharged from ice bank coil 13 is in excess of 4° F., and further in the event that the temperature sense by sensor T1 of the beverage discharge from coil 11 is less than 60° F., then controller 31 of the present invention will effect modulation of valve 29 such that the refrigerant flow through ice bank coil 13 maintains an approximate superheat thereacross of a predetermined value (e.g. 4° F.). In this manner coil 13 is operated at a temperature sufficiently low that water from ice bath 14 will freeze on the coil forming an ice bank of a predetermined size. In accordance with this invention, in the event the temperature of the refrigerant discharged from coil 13 drops below a predetermined temperature (e.g., 4° F.), this signifies that the size of the ice bank formed on coil 13 has attained its desired maximum size and, in a manner as will appear, controller 31 shuts down value 29 and blocks the further flow of refrigerant through coil 13.

In this manner, temperature sensor T5 sensing the temperature of the refrigerant discharged from coil 13 constitutes means for controlling the size of the ice bank on coil 13. It will be understood that other ice bank size controls or sensors, such as the ice bank sensor and control disclosed in the above-noted U.S. Pat. No. 4,754,609, are well known and may be utilized.

In the event the temperature of the beverage discharge from precooler coil 11 exceeds 50° F., controller 31 will effect burst operation of valve 27 and modulation control of valve 27 in the manner heretofore discussed and as show in FIG. 2A.

In the event the temperature of the refrigerant discharged from the suction side of ice bank coil 13 is less than 4° F., both valves 27 and 29 will be deenergized so such that the valves will close and compressor 15 will be turned off. After a predetermined time (e.g., 90 minutes) since shutdown, if for all errors and alarms have been cleared, then controller 31 will initiate start up of the system in the manner heretofore disclosed in regard to FIG. 2A. If the time since shutdown is less than 90 minutes and if all error signals or alarms are cleared, then start up of the cold drink dispenser refrigeration system will also be initiated in the manner heretofore disclosed. It will be understood that microprocessor controller 31 incorporates a timer therein which is used to determine this above-mentioned time delay.

In regard to FIG. 3, refrigeration control system 25 of the present invention is shown in block diagram form. FIG. 3, in conjunction with the detailed electronic schematic of FIG. 4 and with the description of the control logic or strategy as shown in FIGS. 2A–2C (heretofore described), would enable to person of ordinary skill in the art to make and use cold drink dispenser 1 and control system 25.

As heretofore noted, valves 27 and 29 are preferably modulatable expansion valves, and even more preferably are on/off (open/closed) solenoid actuated valves of the type described in the above-noted U.S. Pat. Nos. 4,459,819 and 4,685,309. These on/off solenoid valves have a period (e.g., four seconds) with the duty cycle (i.e., the percent of the period the value is open) ranging from 0 to 100%. Control system 25 of the present invention incorporates proportion plus integration pulse modulated control signals for each of the valves 27 and 29 to regulate the flow of refrigerant therethrough in relation to an actual system parameter (e.g., superheat of their respective coils 11 and 13) relative to prestablished setpoint values (or superheats) in the manner disclosed in the two above-noted U.S. Patents.

Further in accordance with the invention, microprocessor U8 (as shown in FIG. 4) may be programmed so as to determine the amount of load drawn on beverage dispenser 1. In order to accomplish this, microprocessor U8 monitors the control time (i.e., modulation time) for valve 27 for the first coil 11 and this time is accumulated in the microprocessor. This gives an indication of the load (i.e., usage) drawn on the machine. Thus, as beverage is drawn through the beverage dispenser, and if the beverage outlet temperature, as sensed by sensor T1, is above its predetermined temperature level (e.g., 50° F.), control 23 will effect modulation of valve 27. The load on the dispenser is function both of the amount of beverage dispensed and the temperatures of tee incoming beverage from the beverage inlet 7. In warm weather conditions, the incoming beverage is likely (but not necessarily) to be high. This will cause valve 11 to be modulated most of the time when beverage is drawn through flowpath 5. In this manner, the general condition of a light or a heavy load on regrigeration system 3 can be determined.

Heretofore, a problem was occurring in that, under light load conditions, ice bath coil 13 caused too much ice to be grown in ice bath 14. In accordance with this invention, under light load conditions when the modulation time of valve 27 is less than a specified portion of a given length of time, the time valve 29 is modulated is shortened somewhat so as to lessen the makeup of ice since the ice requirement is less.

In view of the above, it will be seen that other objects of this invention are achieved and other advantageous results obtained.

As changes could be made in the above constructions or methods without departing from the scope of the invention, it is intended that all matter contained in the above description or shown in the accompanying drawings shall be interpreted as illustrative and not in a limiting sense.

What is claimed is:

1. In a cold drink dispenser having a beverage inlet, a beverage outlet, a beverage flow path between said inlet and said outlet, and a refrigeration system for chilling said beverage to a predetermined temperature as the beverage flows through said flow path, said refrigeration system comprising a compressor, a condenser for receiving high pressure refrigerant from said compressor, a first coil supplied with high pressure refrigerant from said condenser, a second coil supplied with high pressure refrigerant from said condenser, and a suction line for returning refrigerant from each of said coils to said compressor, an ice bath having a liquid therein, said second coil being at least in part in heat transfer relation with said liquid for forming an ice bank, said flow path being in heat transfer relation first with said first coil and then with said liquid, wherein the improvement comprises: a first modulatable expansion valve between said condenser and said first coil for effecting expansion of said refrigerant as it flows through said first expansion valve, a second modulation expansion valve between said condenser and said second coil for effecting expansion of said refrigerant as it flows through said second expansion valve, control means associated with each of said valves for generating a modulated control signal for each of said valves for effecting modulated control of said valves thereby to regulate the flow of refrigerant through said valves, means for generating a signal responsive to tee temperature of said beverage in said flow path upstream from said second coil with this last said temperature constituting a first coil beverage outlet temperature, means responsive to said first coil beverage outlet temperature for operating said first valve so as to block the flow of refrigerant therethrough when said first coil beverage outlet temperature is below a first predetermined first coil beverage outlet temperature and for modulating said first valve when said first coil beverage outlet temperature is above said first predetermined first coil beverage outlet temperature, and means responsive to the size of said ice bank for blocking operation of said second valve upon said ice bank attaining a desired maximum size and for permitting operation of said second valve upon said ice bank decreasing below said maximum size.

2. In a cold drink dispenser as set forth in claim 1 wherein said means responsive to said the size of said ice bank includes means for sensing the temperature of the refrigerant exiting said second coil and for generating a signal in response thereto, said control means further having means responsive to said second coil refrigerant outlet temperature for operating said second valve so as to block the flow of refrigerant therethrough when said second coil outlet refrigerant temperature is below a predetermined temperature.

3. In a cold drink dispenser having a beverage source, a beverage outlet, a beverage flow path between said source and said outlet and a refrigeration system for chilling said beverage to a predetermined temperature as the beverage flows through said flow path, said refrigerant system comprising a compressor, a condenser for receiving high pressure refrigerant from said compressor, a first coil supplied with high pressure refrigerant from said condenser, a second coil supplied with high pressure refrigerant from said condenser, and a suction line for returning refrigerant from each of said coils to said compressor, said flow path being in heat transfer relation first with said first coil and then with said second coil, wherein the improvement comprises: a first modulatable expansion valve between said condenser and said first coil for effecting expansion of said refrigerant as it flows through said first expansion valve, a second modulatable expansion valve between said condenser and said second coil for effecting expansion of said refrigerant as it flows through said second expansion valve, control means associated with each of said valves for generating a modulated control signal for each of said valves for effecting modulated control of said valves thereby to regulate the flow of refrigerant through said valves, means for generating a signal responsive to the temperature of said beverage in said flow path upstream from said second coil with this last said temperature constituting a first coil beverage outlet temperature, and means responsive to said first coil beverage outlet temperature for operating said first valve so as to block the flow of refrigerant therethrough when said first coil beverage outlet temperature is below a first predetermined first coil beverage outlet temperature and for modulating said first valve when said first coil beverage outlet temperature is above said first predetermined first coil beverage outlet temperature, said dispenser further comprising means for sensing the temperature of the refrigerant exiting said condenser and for generating a signal and response thereto, said control means being responsive to said condenser outlet refrigerant temperature for shutting off said compressor when said condenser outlet refrigerant temperature exceeds a predetermined value.

4. In a cold drink dispenser having a beverage source, a beverage outlet, a beverage flow path between said source and said outlet, and a refrigeration system for chilling said beverage to a predetermined temperature as the beverage flows through said flow path, said refrigeration system comprising a compressor, a condenser for receiving high pressure refrigerant from said compressor, a first coil supplied with high pressure refrigerant from said condenser, a second coil supplied with high pressure refrigerant from said condenser, and a suction line for returning refrigerant from each of said coils to said compressor, said flow path being in heat transfer relation first with said first coil and then with said second coil, wherein the improvement comprises: a first modulatable expansion valve between said condenser and said first coil for effecting expansion of said refrigerant as it flows through said first expansion valve, a second modulatable expansion valve between said condenser and said second coil for effecting expansion of said refrigerant as it flows through said second expansion valve, control means associated with each of said valves for generating a modulated control signal for each of said valves for effecting modulated control of said valves thereby to regulate the flow of refrigerant through said valves, means for generating a signal responsive to the temperature of said beverage in said flow path upstream from said second coil with this last said temperature constituting a first coil beverage outlet temperature, and means responsive to said first coil beverage outlet temperature for operating said first valve so as to block the flow of refrigerant therethrough when said first coil beverage outlet temperature is below a first predetermined first coil beverage outlet temperature and for modulating said first valve when said first coil beverage outlet temperature is above said first predetermined first coil beverage outlet temperature, said dispenser wherein, upon said first coil beverage outlet temperature exceeding said second predetermined temperature level, said control means effecting modulation of said first valve, and wherein, after said first coil beverage outlet temperature exceeding said second predetermined temperature level, but before effecting modulation of said first valve, said control means effecting opening of said first solenoid valve for a predetermined time thereby to facilitate thermal stablization of said first coil.

5. In a cold drink dispenser having a beverage source, a beverage outlet, a beverage flow path between said source and said outlet, and a refrigeration system for chilling said beverage to a predetermined temperature as the beverage flows through said flow path, said refrigeration system comprising a compressor, a condenser for receiving high pressure refrigerant from said compressor, a first coil supplied with high pressure refrigerant from said condenser, a second coil supplied with high pressure refrigerant from said condenser, and a suction link for returning refrigerant from each of said coils to said compressor, said flow path being in heat transfer relation first with said first coil and then with said second coil, wherein the improvement comprises: a first modulatable expansion valve between said condenser and said first coil for effecting expansion of said refrigerant as it flows through said first expansion valve, a second modulatable expansion valve between said condenser and said second coil for effecting expansion of said refrigerant as it flows through said second expansion valve, control means associated with each of said valves for generating a modulated control signal for each of said valves for effecting modulated control of said valves thereby to regulate the flow of refrigerant through said valves, means for generating a signal responsive to the temperature of said beverage in said flow path upstream from said second coil with this last said temperature constituting a first coil beverage outlet temperature, and means responsive to said firs coil beverage outlet temperature for operating said first valve so as to block the flow f refrigerant therethrough when said first coil beverage outlet temperature is below a first predetermined first coil beverage outlet temperature and for modulating said first valve when said first coil beverage outlet temperature is above said first predetermined first coil beverage outlet temperature, wherein said control means includes a microprocessor which includes said means for generating said modulate control signal for each of said valves and said means responsive to said first coil beverage outlet temperature, and wherein said microprocessor has means for monitoring the time said first valve is modulated, means for comparing said first valve modulation time to another time thereby to determine the load on said refrigeration system, and if said load is below preestablished level, means for shortening the time said second valve is modulated.

6. In a cold drink dispenser as set forth in claim 5 wherein said microprocessor being responsive to said first coil beverage outlet temperature such that if said first coil beverage outlet temperature is less than a first predetermined beverage outlet temperature, and if said second coil refrigerant outlet temperature is less than a predetermined refrigerant outlet temperature, said microprocessor operates both of said valves so as to block the flow of refrigerant therethrough and to shut down said compressor.

7. In a cold drink dispenser as set forth in claim 5 wherein said microprocessor further includes a timer, and wherein with both of said valves closed and with said compressor shut down, after the passage of a predetermined time, said microprocessor starts up operation of said compressor and operates both of said valves so as to begin the flow of refrigerant therethrough.

8. In a cold drink dispenser having a beverage source, a beverage outlet, a beverage flow path between said source and said outlet, and a refrigeration system for chilling said beverage to a predetermined temperature as the beverage flows through said flow path, said refrigeration system comprising a compressor, a condenser for receiving high pressure refrigerant from said compressor, a first coil supplied with high pressure refrigerant from said condenser, a second coil supplied with high pressure refrigerant from said condenser, and a suction line for returning refrigerant from each of said coils to said compressor, said flow part being in heat transfer relation first with said first coil and then with said second coil, wherein the improvement comprises: a first modulatable expansion valve between said condenser and said first coil for effecting expansion of said refrigerant as it flows through said first expansion valve, a second modulatable expansion valve between said condenser and said second coil for effecting expansion of said refrigerant as it flows through said second expansion valve, control means associated with each of said valves for generating a modulated control signal for each of said valves for effecting modulated control of said valves thereby to regulate the flow of refrigerant through said valves, means for generating a signal responsive to the temperature of said beverage in said flow path upstream from said second coil wit this last said temperature constituting a first coil beverage outlet temperature, and means responsive to said first coil beverage outlet temperature for operating said first valve so as to block the flow of refrigerant therethrough when said first coil beverage outlet temperature is below a first predetermined first coil beverage outlet temperature and for modulating said first valve when said first coil beverage outlet temperature is above said first predetermined first coil beverage outlet temperature, said dispenser, wherein each of said valves is a solenoid valve having a valve member movable between an open and a closed position upon energization and de-energization thereof, said control signal having a period and a duty cycle corresponding to a ratio of valve open time to the length of said period, said control means periodically energizing and de-energizing each of said solenoid valves, said cold drink dispenser further comprising first means for sensing the superheat of said refrigerant discharged from said first coil, and second means for sensing the superheat for said refrigerant discharged from said second coil, wherein said control system includes means associated with each of said valves for generating a set point signal representative of a desired superheat operating condition of a respective coil, said control signal generating means for each of said valves having an integrator means for integrating an integral control signal for controlling said duty cycle by integrating the difference between said superheat and said set-point signal, and if the difference between said superheat and said set-point is less than zero, decreasing said duty cycle for a respective said solenoid valve, and if the difference between said super heat and said set-point is greater than zero, increasing said duty cycle.

9. In a cold drink dispensing system having a beverage source, a beverage outlet, a beverage flow path between said source and said outlet, and a refrigerant system for chilling said beverage to a predetermined temperature and to maintain said beverage flowing through said flow path and or below said predetermined temperature as the beverage flows through said flow path, said refrigeration system comprising a compressor, a condenser for receiving high pressure refrigerant from said compressor, a first or pre-cooler coil supplied with high pressure refrigerant from said condenser, a second or ice bank coil supplied with high pressure refrigerant from said condenser, and a suction line for returning refrigerant from each of said coils to said compressor, said flow path being in heat transfer relation first with said first coil and then with said second coil, wherein the improvement comprises: a first modulatable expansion valve between said condenser and said first coil for effecting expansion of said refrigerant as it flows through said first expansion valve, a second modulatable expansion valve between said second coil and said condenser for effecting expansion of said refrigerant as it flows through said second expansion valve, each of said modulatable expansion valves being a solenoid valve having a valve member movable between an open and closed position upon energization and de-energization thereof, control means associated with each of said solenoid valves for generating an on-off modulated solenoid control signal having a period and a duty cycle corresponding to a ratio of valve open time to the length of said period, said control means periodically energizing and de-energizing said solenoid valve where the duty cycle of the solenoid control signal regulates the flow of refrigerant through said solenoid valve, means for generating a signal constituting a first coil beverage outlet temperature, said control means being responsive to a system parameter for effecting closing at least one of said solenoid valves for blocking the flow of refrigerant through at least one of said coils, and means for effecting opening of said at least one solenoid valve for a predetermined time thereby to facilitate thermal stabilization of its respective coil.

10. The method of controlling a refrigeration system for a cold frink beverage dispenser, the latter comprising a beverage source, a beverage outlet, add beverage flowpath between said beverage source and said beverage outlet, said refrigeration system chilling said beverage as it flows through said beverage flow path, said refrigeration system comprising a compressor, a condenser for receiving high pressure refrigerant from said compressor, a first or pre-chiller coil supplied with high pressure refrigerant from said condenser, a second or ice bank coil supplied with pressure refrigerant from said condenser, and suction line for returning refrigerant from each of said coils to said compressor, said beverage flow path being in heat transfer relation with said first and said second coils, a first modulatable expansion valve between said first coil and said condenser selectively operable for permitting the flow of said high pressure refrigerant therethrough and for effecting expansion of said high pressure refrigerant and a closed position for blocking the flow of refrigerant therethrough, a second mountable expansion valve between said second coil and said condenser selectively operable for permitting the flow of high pressure refrigerant therethrough and for effecting expansion of said high pressure refrigerant and a closed position for blocking the flow of refrigerant therethrough, and a control system for controlling operation of said first and second modulatable valves and of said compressor, wherein the method comprises the steps of:

(a) generating a first modulated control signal for said first valve, and, in response to said control signal, effecting modulation of said first valve so as to regulate the flow of refrigerant through said first valve;

(b) generating a second modulated control signal for said second valve, and, in response to said control signal, regulate the flow of refrigerant through said second solenoid valve;

(c) generating a set point signal for each of said valves representative of a desired superheat operating condition for each said first and second coils;

(d) monitoring the actual superheat operating conditions for each said first and second coils;

(e) for each of said valves, comparing their respective set point signals to their respective actual superheat operating conditions and correspondingly modulating each of said valves thereby to operate said respective coils at or near their respective desired superheat operating conditions;

(f) monitoring the temperature of said beverage in sad flow path upstream from said second coil, this last-said temperature constituting a first coil beverage outlet temperature;

(g) if said first coil beverage outlet temperature is less than a predetermined temperature, operating said first valve so as to block the flow of refrigerant through said first coil; and (h) if said first coil beverage outlet temperature is greater than the above-said predetermined temperature, operating said first valve so as to regulate the flow of refrigerant through said first coil such that the actual superheat of the refrigerant exiting said first coil approximates or equals said desired superheat of said first coil.

11. The method as set forth in claim 10 further comprising the steps of monitoring the temperature of said refrigerant discharged from said second coil, and, if this last said refrigerant temperature is less than a predetermined temperature and if said first coil beverage discharge temperature is less than its said predetermined temperature, operating both of said valves so as to block the flow of refrigerant therethrough, and shutting down operation of said compressor.

12. The method of claim 11 further comprising the steps such that if said refrigerant discharge temperature from said second coil is greater than said predetermined temperature therefor, operating said second solenoid valve so as to regulate the flow of refrigerant through said second coil such that the actual superheat of said second coil approximates said desired superheat operating condition of said second coil.

13. The method of claim 10 further comprising the step of, prior to start up of said compressor, opening one of said valves so as to substantially equalize pressure between said first and second coils.

14. The method of claim 10 further comprising monitoring the temperature of said refrigerant discharged from said condenser, and if this said condenser discharge refrigerant temperature exceeds the predetermined temperature, operating both of said valves so as to block the flow of refrigerant therethrough and shutting down operation of said compressor.

15. The method of controlling a refrigeration system for a cold drink beverage dispenser, the latter comprising a beverage source, a beverage outlet, and beverage flowpath between said beverage source and said beverage outlet, said refrigeration system chilling said beverage as it flows through said beverage flow path, said refrigeration system comprising a compressor, a condenser for receiving high pressure refrigerant from said compressor, a first or pre-chiller coil supplied with high pressured refrigerant from said condenser, a second or ice bank coil supplied with high pressure refrigerant from said condenser, and suction line for returning refrigerant from each of said coils to said compressor, said beverage flow part being in heat transfer relation with said first and said second coils, a first solenoid valve between said first coil and said condense selectively operable between an open position for permitting the flow of said high pressure refrigerant therethrough and for effecting expansion of said high pressure refrigerant and a closed position for blocking the flow of refrigerant therethrough, a second solenoid valve between said second coil and said condenser selectively operable between an open position for permitting the flow of high pressure refrigerant therethrough ad for effecting expansion of said high pressure refrigerant and a closed position for blocking the flow of refrigerant therethrough, and a control system for controlling operation of said first and second solenoid valves and of said compressor, wherein the method comprises the steps of:

(a) generating an on-off modulated control signal for said first solenoid valve having a period and a duty cycle corresponding to a ratio of valve open time to the length of said period;

(b) in response to said control signal, periodically energizing and de-energizing said first solenoid valve so that the duty cycle of said first solenoid valve control signal regulates the flow of refrigerant through said first solenoid valve;

(c) generating a set point signal for each of said solenoid valves representative of a desired superheat operating condition for each said first and second coils;

(d) in response to said control signal, periodically energizing and de-energizing said second solenoid valve where the duty cycle of said second solenoid valve control signal regulates the flow of refrigerant through said second solenoid valve;

(e) generating a set point signal for each of said solenoid valves representative of a desired superheat operating condition for each said first and second coils;

(f) for each of said solenoid valves, comparing their respective set point signals to their respective actual superheat operating conditions and correspondingly increasing or decreasing the duty cycle of each of said solenoid valves thereby to operate said respective coils at or near their respective desired superheat operating conditions;

(g) monitoring the temperature of said beverage in said flow path upstream from said second coil, this last-said temperature constituting first coil outlet temperature;

(h) if said first coil beverage outlet temperature is less than a predetermined temperature, operating said solenoid valve so as to block the flow of refrigerant through said first coil; and (i) if said first coil beverage outlet temperature is greater than the above-said predetermined temperature, operating said first solenoid valve so as to regulate the flow of refrigerant through said first coil such that the actual superheat of the refrigerant exiting said first coil approximates or equals said desired superheat of said first coil.

16. The method of controlling a refrigerant system for a fluid dispenser, the latter comprising a fluid source, a fluid outlet, and fluid flowpath between said fluid source and said fluid outlet, said refrigeration system chilling said fluid as it flows through said flow path, said refrigeration system comprising a compressor, a condenser for receiving high pressure refrigerant from said compressor, a first or pre-chiller coil supplied with high pressured refrigerant from said condenser, a second or ice bank coil supplied with high pressure refrigerant from said condenser, and a suction line for returning refrigerant from each of said coils to aid compressor, said flow path being in heat transfer relation with said first and said second coils, a first solenoid valve between said first coil and said condenser selectively operable between an open position for permitting the flow of said high pressure refrigerant therethrough and for expansion of said high pressure refrigerant and a closed position for blocking the flow of refrigerant therethrough, a second solenoid vale between said second coil and said condenser selectively operable between an open position for permitting the flow of high pressure refrigerant therethrough and for the expansion of said high pressure refrigerant and a closed position for blocking the flow of refrigerant therethrough, and a closed system for controlling operation of said first and second solenoid valves and of said compressor, wherein the method comprises the steps of:

(a) generating an on-off modulated control signal for said first solenoid valve having a period and a duty cycle corresponding to a ratio of valve open time to the length of said period;

(b) in response to said control signal, periodically energizing and de-energizing said first solenoid valve so that the duty cycle of said first solenoid valve control signal regulates the flow of refrigerant through said first solenoid valve;

(c) generating an on-off modulated control signal for said second solenoid valve having a period and a duty cycle corresponding to a radio of valve open time to the length of said period;

(d) in response to said control signal, periodically energizing and de-energizing said second solenoid valve where the duty cycle of said second solenoid valve control signal regulates the flow of refrigerant through said second solenoid valve;

(e) generating a set point signal for each of said solenoid valves representative of a desired superheat operating condition for each said first and second coils;

(f) for each of said solenoid valves, comparing their respective superheat operating conditions to their respective actual superheat operating conditions and correspondingly increasing or decreasing the duty cycle of each of said solenoid valves thereby to operate said respective coils at or near their respective desired superheat operating conditions with varying refrigeration loads on the coils;

(g) monitoring the temperature of said fluid in said flow path upstream from said second coil, this last-said temperature constituting a first coil outlet temperature;

(h) if said first coil fluid outlet temperature is less than a predetermined temperature, operating said solenoid valve so as to block the flow of refrigerant through said first coil;

(i) if said first coil fluid outlet temperature is greater than the above said predetermined temperature, operating said first solenoid valve so as to regulate the flow of refrigerant through said first coil such that the actual superheat of the refrigerant exiting said first coil approximates or equals said desired superheat of said first coil;

(j) monitoring the temperature of said refrigerant discharged from said second coil;

(k) if this last said refrigerant temperature is less than a predetermined temperature and if said first coil fluid discharge temperature is less than its said predetermined temperature, operating both of said solenoid so as to block the flow of refrigerant therethrough; and (l) if said refrigerant discharge temperature from said second coil is greater than said predetermined temperature therefore, operating said second solenoid valve so as to regulate the flow of refrigerant through said second coil such that the actual superheat of said second coil approximates or equals said desired superheat of said second coil.

17. The method of claim 16 further comprising the steps of, prior to start up of said compressor, opening at least one of said solenoid valves so as to equal pressure between said first and second coils.

18. The method of claim 16 further comprising the steps of, prior to initiating operation of either of said first or second solenoid valves so as to regulate the flow of refrigerant therethrough, opening one or both of said solenoid valves for a time sufficient so as to substantially stabilize the dynamic characteristics of the refrigerant within said coils upon start-up and, after such stabilization is substantially achieved, regulating the flow of refrigerant through said solenoid valves in accordance with said duty cycle therefore.

19. The method of claim 16 further comprising monitoring the temperature of said refrigerant discharged from said condenser, and if this said condenser discharge refrigerant temperature exceeds the predetermined temperature, operating both of said solenoid valves so as to block the flow of refrigerant therethrough and shutting down operation of said compressor.

* * * * *